US006551156B2

(12) United States Patent
Nakamura et al.

(10) Patent No.: US 6,551,156 B2
(45) Date of Patent: Apr. 22, 2003

(54) INDUCTION SYSTEM FOR PERSONAL WATERCRAFT

(75) Inventors: Mitsuyoshi Nakamura; Yoshimasa Kinoshita, both of Shizuoka (JP)

(73) Assignee: Sanshin Kogyo Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/906,034

(22) Filed: Jul. 11, 2001

(65) Prior Publication Data

US 2002/0052158 A1 May 2, 2002

(30) Foreign Application Priority Data

Jul. 11, 2000 (JP) ..... 2000-210350
Jul. 11, 2000 (JP) ..... 2000-210351

(51) Int. Cl.[7] ..... B63H 21/32
(52) U.S. Cl. ..... 440/89; 114/55.5; 123/336
(58) Field of Search ..... 114/55.5, 55.57; 440/88, 89; 123/336, 579, 583

(56) References Cited

U.S. PATENT DOCUMENTS 4,232,640 A * 11/1980 Matsumoto et al. ..... 123/336
5,803,044 A 9/1998 Kato ..... 123/336
5,879,211 A 3/1999 Koyanagi ..... 440/89
5,902,158 A 5/1999 Nakase et al. ..... 440/88
5,906,524 A 5/1999 Ozawa et al. ..... 440/88
5,957,072 A 9/1999 Hattori ..... 114/55.57
5,967,861 A 10/1999 Ozawa et al. ..... 440/1
6,015,321 A 1/2000 Ozawa et al. ..... 440/88
6,029,639 A * 2/2000 Mashiko ..... 123/579
6,132,274 A 10/2000 Nanami ..... 440/77
6,250,980 B1 * 6/2001 Ozawa ..... 114/55.5
6,253,696 B1 * 7/2001 Mashiko ..... 114/55.5
6,263,851 B1 * 7/2001 Henmi ..... 440/88
6,312,299 B1 * 11/2001 Henmi ..... 440/88
6,375,527 B2 * 4/2002 Gohara ..... 114/55.5

OTHER PUBLICATIONS

Co–pending patent application: Ser. No. 09/451,365, filed Nov. 30, 1999, entitled Marine Engine for Small Watercraft, in the name of Tetsuya Mashiko, and assigned to Yamaha Hatsudoki Kabushiki Kabushiki Kaisha.

Co–pending patent application: Ser. No. 09/669,484, filed Sep. 25, 2000, entitled Air Induction System for Small Watercraft, in the name of Gohara et al, and assigned to Sanshin Kogyo Kabushiki Kaisha.

Co–pending patent application: Ser. No. 09/813465, filed Mar. 19, 2001, entitled Engine Output Control for Watercraft, in the name of Iida et al., and assigned to Yamaha Hatsudoki Kabushiki Kaisha.

* cited by examiner

*Primary Examiner*—S. Joseph Morano
*Assistant Examiner*—Lars A. Olson
(74) *Attorney, Agent, or Firm*—Knobbe, Martens, Olson & Bear, LLP.

(57) ABSTRACT

A small watercraft includes an engine and an improved induction and charging forming system. The engine includes a fuel injection system with at least one fuel injector and a fuel delivery conduit for supplying fuel to the at least one fuel injector. The induction system includes an intake box configured to protect the at least one fuel injector and the fuel delivery conduit from damage that can be caused by heat generated from a portion of an exhaust system and/or water that may collect in a hull of the watercraft. The induction system can also include a set of throttle bodies. Each throttle body includes a throttle valve. The throttle valves are connected to a throttle shaft assembly. A pulley is attached to the throttle shaft assembly and is disposed between adjacent throttle bodies.

49 Claims, 9 Drawing Sheets

INDUCTION SYSTEM FOR PERSONAL WATERCRAFT

PRIORITY INFORMATION

This invention is based on and claims priority to Japanese Patent Application No. 2000-210350, filed Jul. 11, 2000, and Japanese Patent Application No. 2000-210351, filed Jul. 11, 2000, the entire contents of which are hereby expressly incorporated by reference.

BACKGROUND OF THE INVENTION

1. Field of the Invention

This invention relates to an engine for a watercraft, and particularly to an improved induction and charge forming system of an engine for a watercraft.

2. Description of the Related Art

Personal watercraft have become popular in recent years. This type of watercraft is quite sporting in nature and carries a rider and possibly one, two, or three passengers. A relatively small hull of the personal watercraft commonly defines a rider's area above an engine compartment. An internal combustion engine frequently powers a jet propulsion unit that propels the watercraft. The engine lies within the engine compartment in front of a tunnel (e.g., a recess) formed on the underside of the watercraft hull. The jet propulsion is located within the tunnel and is driven by a driveshaft. The driveshaft usually extends between the engine and the jet propulsion device through a wall of the hull tunnel.

Personal watercraft are commonly powered by two-cycle engines, which have the advantage of being fairly powerful and relatively light and compact. However, two-cycle engines typically produce a relatively large quantities of carbon monoxide and various hydrocarbons. To reduce these emissions, fuel injection systems have replaced carburetors in some watercraft as the engine charge former. In such fuel injections systems, fuel can be injected into an induction system of the engine upstream of the combustion chamber. The principal advantage of fuel injection systems is that the amount of fuel injected into the combustion chamber can be precisely controlled. By precisely controlling the amount of fuel injected, the fuel/air ratio within the combustion chamber can be optimized to reduce emissions.

As with two-cycle engines with carburetors, the amount of air supplied to the combustion chamber typically is controlled by a throttle valve that is disposed in an air intake passage of the induction system. The throttle valve, in turn, is coupled to a throttle lever. A rider of the personal watercraft can control the position of the throttle valve through the throttle valve. In general, as the throttle valve opens, the output of the engine tends to increase.

Fuel injection engines typically include an engine control system for determining and controlling the fuel/air ratio. The engine control system typically calculates the amount of air entering the combustion chamber and then determines the amount of fuel to inject through the fuel injectors to achieve the desired fuel/air ratio. The amount of air entering the combustion chamber can be determined from the position a throttle valve sensor, which senses the position of the throttle valve. The amount of fuel injected through the fuel injectors typically is determined by measuring the fuel pressure at the fuel injectors and controlling the duration that the fuel injectors are open.

There are, however, several problems associated determining the position of the throttle valve and the amount of fuel injected through the fuel injectors. For example, in a multi-cylinder engine, the induction system typically includes several throttle valves (e.g., one throttle valve per cylinder). The multiple throttle valves in some engines are attached to a single throttle valve shaft. A pulley, which is attached to one end of the shaft, is used to rotate the shaft. As the throttle shaft rotates, the torque applied to the pulley can cause the throttle valve shaft to twist and/or bend. This can result in a difference between the position of the throttle valve closest the pulley and the throttle valve furthest from the pulley. These differences can result in an inaccurate determination of the amount of air entering each cylinder.

With respect to the fuel injectors, this component can become damaged during operation of the watercraft. For example, the fuel injectors can be damaged by heat that is generated by some engine components, such as, for example, the exhaust system. Moreover, because of its sporting nature, personal watercraft are often tilted on its side or are flipped over by advanced riders during use. As such, water can accumulate within the engine compartment. This water may splash upon and also damage the fuel injectors. If damaged, an inaccurate amount of fuel may be injected into the combustion chambers.

Therefore, a needs exists for a personal watercraft with an improved induction and charge forming system that results in more accurate measurement of the throttle position and/or the amount of fuel being injected into the combustion chambers.

SUMMARY OF THE INVENTION

Accordingly, one aspect of the present invention is a small watercraft comprising a hull defining an engine compartment. An internal combustion engine is disposed within the engine compartment. The engine has an engine body containing at least one combustion chamber and an output shaft that drives a propulsion device of the watercraft. An induction system is arranged within the hull to supply air to the combustion chamber. The induction system includes at least one intake conduit, at least one throttle body that communicates with the intake conduit, and at least one intake box. The intake conduit has an outlet end connected to the engine body and extends generally away from the engine body. The throttle body is connected to an inlet of the intake conduit and also generally extends away from the engine body. The intake conduit and the throttle body define an intake passage. The intake box is connected to an inlet end of the throttle body. The engine further includes at least one fuel injector that is connected to a fuel delivery conduit and is arranged to inject fuel into the intake passage. The intake box defines a recess in which at least a portion of the fuel delivery conduit or the fuel injector is at least partially disposed.

Another aspect of the present invention is a small watercraft comprising a hull defining an engine compartment. An internal combustion engine is disposed within the engine compartment. The engine has an engine body containing at least one combustion chamber and an output shaft that drives a propulsion device of the watercraft. An induction system is arranged within the hull to supply air to the combustion chamber. The induction system includes at least one intake conduit, at least one throttle body that communicates with the intake conduit, and at least one intake box. The intake conduit has an outlet end connected to the engine body and extends generally away from the engine body. The throttle body is connected to an inlet of the intake conduit and also generally extends away from the engine body. The intake conduit and the throttle body define an intake passage.

The intake box is connected to an inlet end of the throttle body. The engine further includes at least one fuel injector that is connected to a fuel delivery conduit and is arranged to inject fuel into the intake passage. The intake box defines a shield positioned generally above or generally below at least a portion of the fuel delivery conduit or the fuel injector.

Yet another aspect of the present invention is a small watercraft comprising a hull defining an engine compartment. An internal combustion engine is disposed within the engine compartment and has an engine body containing at least one combustion chamber. The engine also includes an output shaft that drives a propulsion device of the watercraft. An induction system is arranged within the hull to supply air to the combustion chamber. The induction system including at least one intake conduit, at least a first throttle body and a second throttle body that communicate with the intake conduit, and at least one intake box. The intake conduit has an outlet end connected to the engine body. The throttle body is connected to an inlet of the intake conduit. The intake conduit and the throttle body define an intake passage. The intake box is connected to an inlet end of the throttle body. At least one fuel injector is connected to a fuel delivery conduit and is arranged to inject fuel into the intake passage. The first throttle body includes a first throttle valve positioned on a first throttle shaft. The second throttle body includes a second throttle valve positioned on a second throttle shaft. A pulley is mounted on either the first or second throttle shaft and disposed between the first and second throttle bodies. The pulley being coupled to a throttle operator.

Further aspects, features and advantages of the present invention will become apparent from the following description of the preferred embodiments.

BRIEF DESCRIPTION OF THE DRAWINGS

The above-mentioned and other features of the invention will now be described with reference to the drawings of preferred embodiments of the induction and charge forming system in the context of a personal watercraft. The illustrated embodiments of the induction and charge forming system are intended to illustrate, but not to limit the invention. The drawings contain 10 figures.

DETAILED DESCRIPTION OF THE PREFERRED EMBODIMENT

Figure 1:
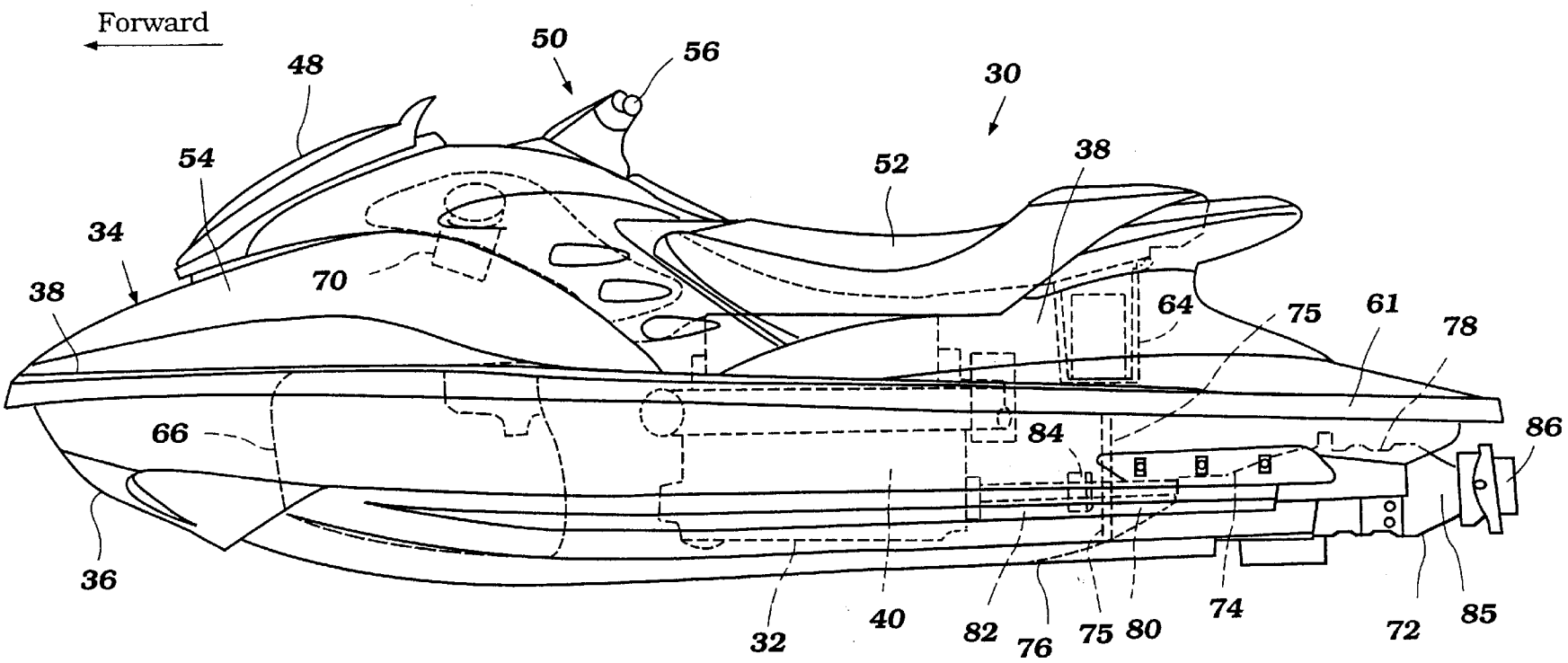
FIG. 1 is a side elevational view of a personal watercraft of the type powered by an engine configured in accordance with a preferred embodiment of the present invention. Several of the internal components of the watercraft (e.g., the engine) are illustrated in phantom.
Figure 2:
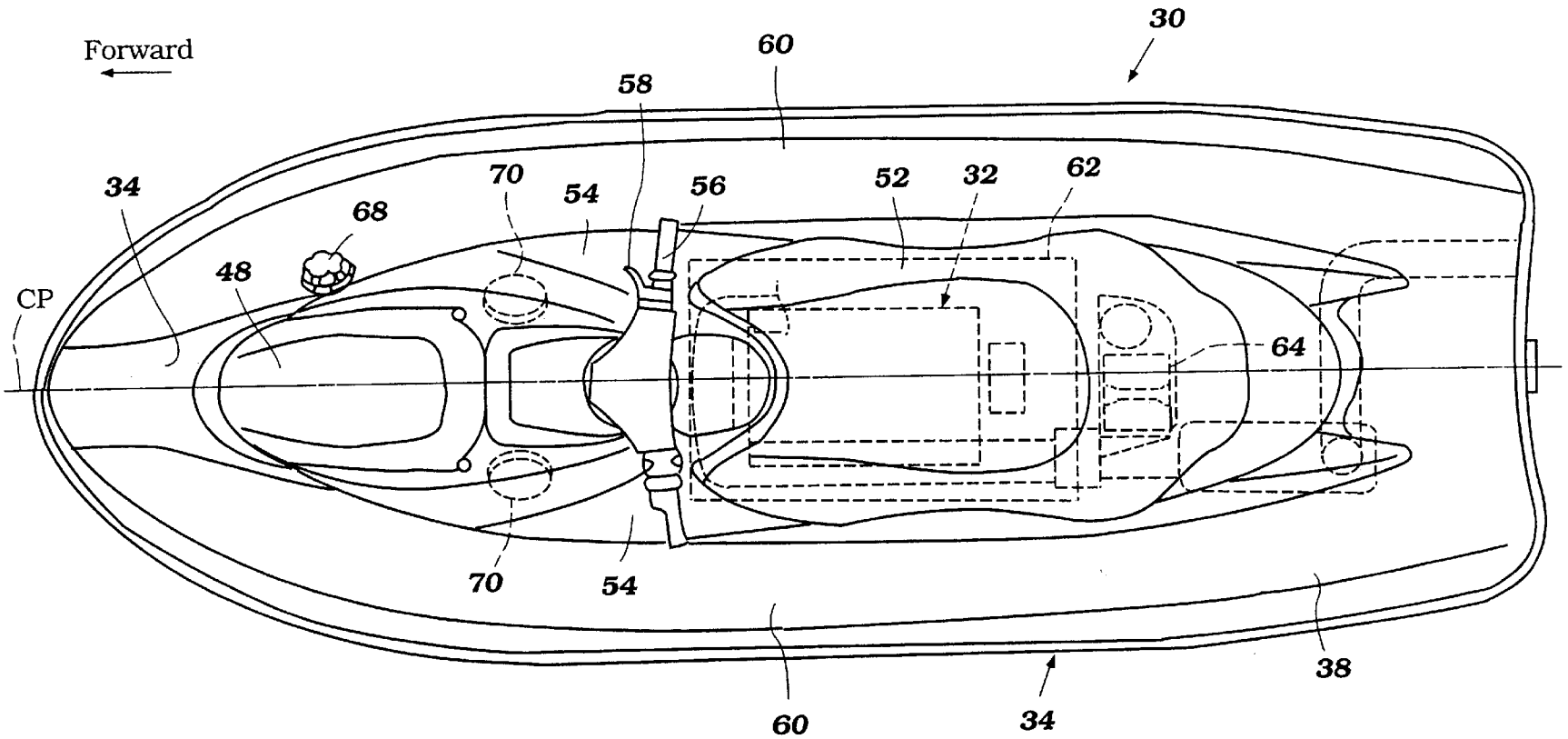
FIG. 2 is a top plan view of the watercraft of FIG. 1.

With reference initially to FIGS. 1 and 2, an overall configuration of a personal watercraft 30 will be described.

The watercraft 30 employs an internal combustion engine 32 configured in accordance with the preferred embodiment of the present invention. The described engine configuration has particular utility with the personal watercraft, and thus, is described in the context of the personal watercraft. The engine configuration, however, can be applied to other types of watercrafts as well, such as, for example, small jet boats.

The personal watercraft 30 includes a hull 34 formed with a lower hull section 36 and an upper hull section or deck 38. Both the hull sections 36, 38 are made of, for example, a molded fiberglass reinforced resin or a sheet molding compound. The lower hull section 36 and the upper hull section 38 are coupled together to define an internal cavity 40 (see also FIG. 4).

The hull 34 defines a center plane CP that extends generally vertically from bow to stern. Along the center plane CP, the upper hull section 34 includes a hatch cover 48, a control mast 50 and a seat 52 arranged from fore to aft. In the illustrated embodiment, a bow portion 54 of the upper hull section 38 slopes upwardly and an opening is provided through which the rider can access the internal cavity 40. The bow portion 54 preferably is provided with a pair of cover member pieces which are apart from one another along the center plane CP. The hatch cover 48 is detachably affixed (e.g., hinge) to the bow portion 54 so as to cover the opening. The control mast 50 extends upwardly to support a handlebar 56. The handlebar 56 is provided primarily for controlling the direction in which the water jet propels the watercraft 30. Grips are formed at both ends of the handlebar 56 so that the rider can hold them for that purpose. The handlebar 56 also carries other control units such as a throttle lever 58 that is used for control of the running conditions of the engine 32.

The seat 52 extends along the center plane CP to the rear of the bow portion 54. The seat 52 also generally defines the rider's area. The seat 52 has a saddle shape and hence a rider can sit on the seat 52 in a straddle-type fashion. A plurality of foot areas 60 are defined on both sides of the seat 52 and at the top surface of the upper hull section 38. The foot areas 60 are formed generally flat and are surrounded by gunnels 61, which are formed by the lower and upper hull sections 36, 38. A cushion supported by the upper hull section 38, at least in principal part, forms the seat 52. The seat 52 is detachably attached to the upper hull section 38. An access opening 62 is defined under the seat 52 through which the rider can also access the internal cavity 40. That is, the seat 52 usually closes the access opening 62. In the illustrated embodiment, the upper hull section 38 also defines a storage box 64 under the seat 52.

A fuel tank 66 is disposed in the cavity 40 under the bow portion 54 of the upper hull section 38. The fuel tank 66 is coupled with a fuel inlet port positioned at a top surface of the upper hull section 38 through a duct. A closure cap 68 closes the fuel inlet port. The opening disposed under the hatch cover 48 is available for accessing the fuel tank 66.

The engine 32 is disposed in an engine compartment defined in the cavity 40. The engine compartment preferably is located under the seat 52, but other locations are also possible (e.g., beneath the control mast or in the bow.) The rider thus can access the engine 32 in the illustrated embodiment through the access opening 62 by detaching the seat 52.

A plurality of air ducts or ventilation ducts 70 are provided on both sides of the bow portion 54 so that the ambient air can enter the internal cavity 40 therethrough. Except for the air ducts 70, the engine compartment is substantially sealed so as to protect the engine 32 and other components from water.

A jet pump system 72 propels the watercraft 30. The jet pump system 72 includes a tunnel 74 formed on the underside of the lower hull section 36 which is isolated from the engine compartment by a bulkhead 75. The tunnel 74 has a downward facing inlet port 76 opening toward the body of water. A jet pump housing 78 is disposed within a portion of the tunnel 74 and communicates with the inlet portion 76. An impeller (not shown) is supported within the housing 78.

An impeller shaft 80 of the jet pump system 72 extends forwardly from the impeller and is coupled with a crankshaft 82 of the engine 32 at least in part by a coupling member 84. The crankshaft 82 of the engine 32 thus drives the impeller shaft 80. The rear end of the housing 78 defines a discharge nozzle 85 and a steering nozzle 86 is affixed to the discharge nozzle 85 for pivotal movement about a steering axis extending generally vertically. The steering nozzle 86 is connected to the handlebar 56 by a cable so the rider can pivot the nozzle 86.

As the engine 32 drives the impeller shaft 80 and hence rotates the impeller, water is drawn from the surrounding body of water through the inlet port 76. The pressure generated in the housing 78 by the impeller produces a jet of water that is discharged through the steering nozzle 86. This water jet propels the watercraft 30. The rider can move the steering nozzle 86 with the handlebar 56 when he or she desires to turn the watercraft 80 in either direction.

Figure 4:
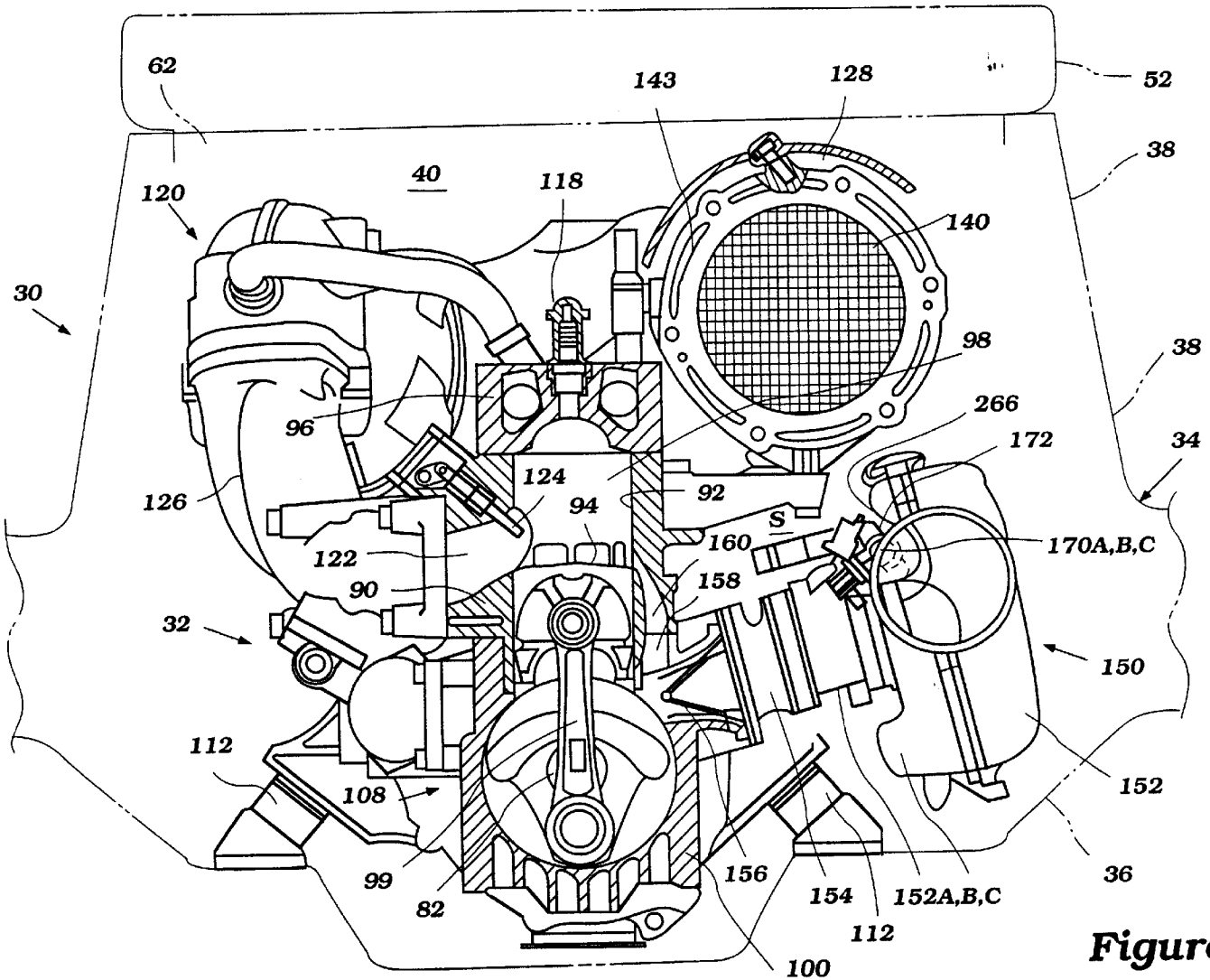
FIG. 4 is a review view of the engine, the exhaust system and the induction system with a cylinder of the engine and a catalyst of the exhaust system shown in cross-section.

The engine 32 of the illustrated arrangement operates on a two-stroke crankcase compression principle. With reference to FIG. 4, the engine 32 includes a cylinder block 90. In the illustrated embodiment, the cylinder block 90 defines three cylinder bores 92 spaced from each other from fore to aft generally along the center plane CP. It should be appreciated that the illustrated engine merely exemplifies one type of engine on which various aspects and features of the induction and charging forming system can be used. An engine having other numbers of the cylinders, having other cylinder arrangements, having other cylinder orientations (e.g., upright cylinder banks, V-type, W-type) and operating on other combustion principles (e.g., four-cycle, diesel, and rotary) are all practicable.

Pistons 94 reciprocate within the cylinder bores 92. A cylinder head 96 is affixed to the upper end of the cylinder block 90 to close respective upper ends of the cylinder bores 92 and defines four combustion chambers 98 with the cylinder bores 92 and the pistons 94. The cylinder head 96 can be an assembly formed by multiple members or a single head piece. Connecting rods 99 connect the pistons 94 to the crankshaft 82 that is housed within a crankcase member 100.

The cylinder block 90, the cylinder head 96, and the crankcase member 100 together define an engine body 108. The engine body 108 preferably is made of an aluminum based alloy. In the illustrated embodiment, the engine body 108 is oriented in the engine compartment so as to position the crankshaft 82 in the center plane CP and to extend generally in the longitudinal direction. Other orientations of the engine body, of course, are also possible (e.g., with a transverse or vertical oriented crankshaft).

A plurality of engine mounts 112 extend from both sides of the engine body 108. The engine mounts 112 preferably include resilient portions made of, for example, a rubber material. The engine 32 preferably is mounted on the lower hull section 36, specifically, a hull liner, by the engine mounts 112 so that vibration of the engine 32 is inhibited from conducting to the hull section 36.

Spark plugs 118 are mounted within the cylinder head 96 with their gaps extending into the combustion chambers 98. The spark plugs 118 are fired by an ignition control unit that is controlled by an electronic control unit (ECU) of the engine 32 as is well known in the art. The spark plugs 118 are connected to the ignition control unit by spark plug leads (not shown).

An exhaust system 120 is provided for discharging exhaust gases from the engine 32 to the atmosphere and/or to the water. With continued reference to FIG. 4 and additional reference to FIG. 3, the exhaust system 120 preferably includes exhaust passages 122 that are associated each combustion chamber 98 and are formed in the cylinder block 90. In the illustrated arrangement, a sliding type exhaust timing control valve 124 is provided in the exhaust passage 122 for controlling the timing of the opening and closing of the exhaust passages 122 as is known in the art.

The exhaust system 120 preferably also includes an exhaust manifold 126, which in the illustrated arrangement is affixed to the port side of the cylinder block 90. The outlet of the exhaust manifold 126 communicates with an expansion chamber 128, which includes an upstream section 130 and a C-shaped downstream section 132. The upstream section 130 is directly connected to the outlet of the exhaust manifold 126 and extends upwardly and forwardly to the C-shaped downstream section 132. The C-shaped downstream section 132, in turn, wraps around the front of the engine 32 and along the starboard side of the engine 32 at an elevation that preferably is generally at or above to the cylinder head 96. The outlet of the C-shaped section 132 extends generally rearwardly along the starboard side of the engine 32 and is connected to an exhaust pipe 134.

The exhaust pipe 134 preferably is connected to a water trap device (not shown) through a rubber hose 136. The water trap device inhibits the back flow of water into the exhaust pipe 134 and into the exhaust system 120 in general. A second exhaust pipe (not shown) preferably couple the water trap device to a discharge opening (not shown) for discharging the exhaust gases to a body of water in which the personal watercraft 30 is operating. Preferably, the second exhaust pipe extends up and over the jet pump 72 so as to further inhibit the influx of water into the exhaust system 120.

As best seen in FIG. 4, the exhaust system 120 preferably encircles and is positioned above, at least partially, the engine 32. In particular, it is preferred that the expansion chamber 128 be positioned, at least partially, above the level of the cylinder head a member 96. By encircling the engine 32 in this manner, the exhaust system 120 affords some protection against water in the engine compartment inadvertently splashing against the spark plugs 118 during use of the watercraft 30. One or more additional water traps or exhaust treatment devices (e.g., resonators) can be disposed between the watertrap device and the discharge opening.

A catalyst assembly 138 is preferably provided between the C-shaped downstream section 132 and the exhaust pipe 134. The catalyst assembly 138 includes a catalyst 140, such as, for example, a honeycombed-type catalyst bed designed for treating hydrocarbons, carbon monoxide and nitrogen oxides. The exhaust system 120 preferably includes a cooling jacket 142, which defines cooling passages 143 that surround the outlet of the C-shaped downstream section 132, the catalyst assembly 134 and the exhaust pipe 134. The cooling passages 142 serve to cool the exhaust gases before they are discharged.

Figure 3:
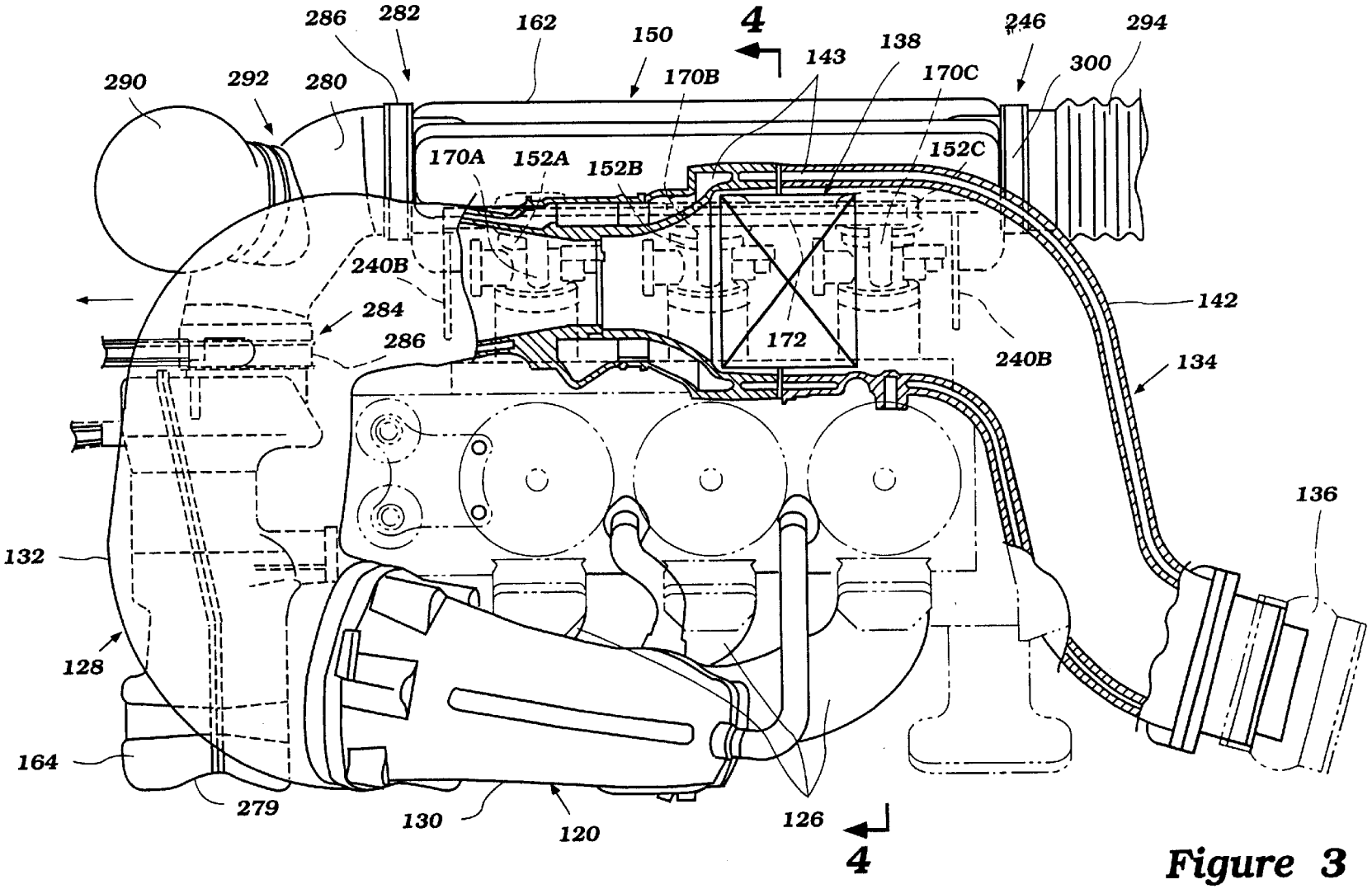
FIG. 3 is a partial top plan view of the engine of FIG. 1 and its exhaust and induction systems, with a portion of the exhaust system shown in section to reveal the interior thereof.

With continued reference to FIGS. 3 and 4 the engine 32 preferably includes an air induction system 150 to introduce air to the combustion chambers 98. The air induction system 150 includes a plurality of throttle bodies 152A–C. In the illustrated arrangement, each cylinder bore 92 of the engine 32 is associated with one throttle body 152A–C. As such, the illustrated air induction system 150 includes three throttle bodies 152A–C. The throttle bodies 152A–C are connected to the crankcase member 100 by an intake conduit 154, which preferably in the form of a manifold defining several intake conduits each of which is connected to a single throttle body. The manifold 154 is made of a resilient, flexible material, such as, for example, rubber. The manifold 154 is attached to the crankcase member by a plurality of bolts 151 (see FIG. 7).

Figure 6:
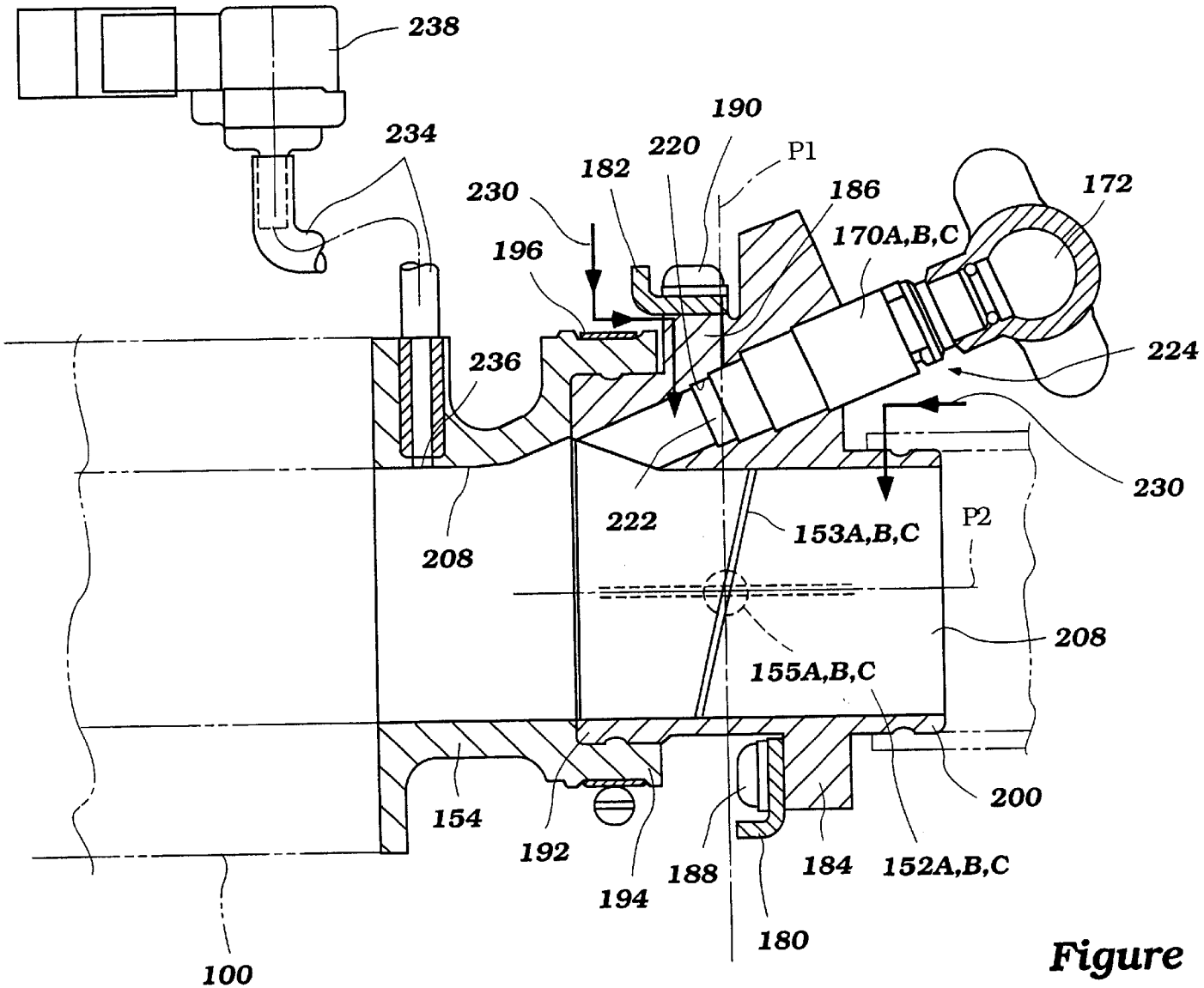
FIG. 6 is a cross-sectional view of a portion of the induction and charge forming system taken along the line 6—6 of FIG. 5.

As seen in FIG. 6, each of the throttle bodies 152A–C includes a throttle valve 153A–C. Pivotal movement of the throttle valves 153A–C is controlled by the throttle lever 58 (see FIG. 2) on the handlebar 56 through a control cable that is coupled to a set of throttle valve shafts 155A–C as will be explained in more detail below. The rider thus can control opening amount of the throttle valves 152A–C by operating the throttle lever 58 so as to obtain various running conditions of the engine 32 that the rider desires. That is, an amount of air passing through the throttle bodies 152A–C is controlled by this mechanism.

With reference back to FIGS. 3 and 4, a reed valve 156 as is well known in the art air selectively allows air into the crankcase member 100 from the throttle bodies 152A–C and manifold 154. The crankcase member 100 itself is compartmentalized to provide the crankcase compression features for each combustion chamber 98 as is well known in the operation of two-cycle engines. The charge within the crankcase member 100 is delivered to each combustion chamber 98 through several scavenge passages 158 formed in the cylinder block 90. The scavenge passages 158 terminate at a number of scavenge ports 160 formed on the cylinder bore 92.

The air induction system 150 also includes a first air intake box 162, which supplies air to the throttle bodies 152. A second intake box 164 and a third intake box 166 are also preferably provided. These intake boxes 162, 164, 166 or "plenum chambers" are provided for smoothing the intake air and acting as an intake silencer. These components and the remaining portions of the induction system 150 will be described in detail below.

Figure 7:
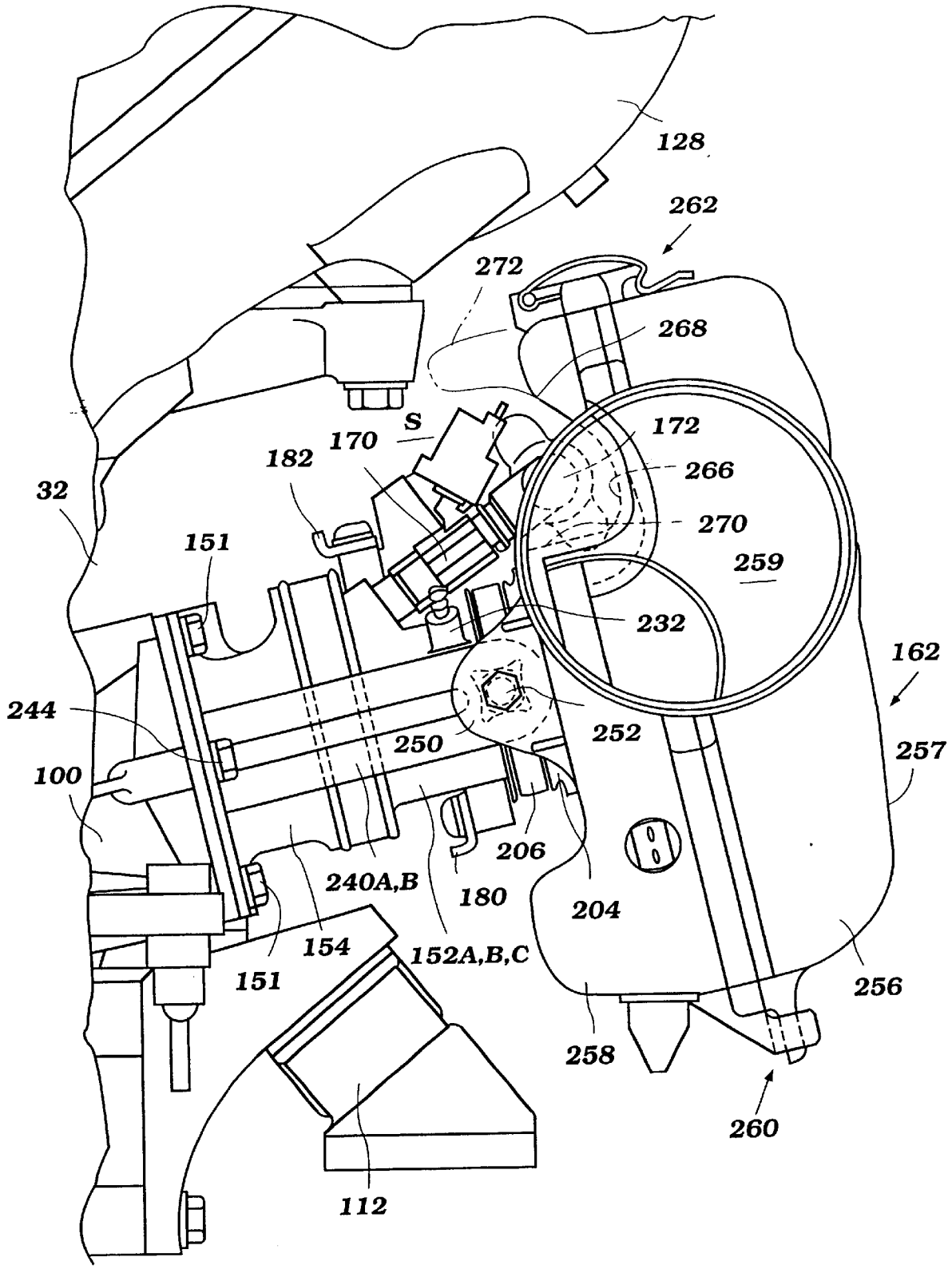
FIG. 7 is enlarged view of a portion the induction and charging forming system shown in FIG. 4.

The engine 32 includes a fuel supply system, portions of which are best seen FIGS. 1, 3 and 7. The fuel supply system includes the fuel tank 66, at least one fuel delivery conduit 172 and a plurality of fuel injectors 170A–C. As will be explained in detail below, the fuel injectors 170A–C of the illustrated embodiment are mounted to the throttle bodies 152A–C. Moreover, in the illustrated embodiment, the at least one fuel delivery conduit 172 is in the form of a fuel rail that supplies fuel to each of the fuel injectors 170A–C and to which the fuel injectors 170A–C are affixed. In one variation, the at least one fuel delivery conduit 172 can be in the form of fuel lines that connect the fuel injectors 170A–C. Such fuel lines can be arranged in series or in parallel.

The fuel injectors 170A–C spray the fuel into the throttle bodies 152A–C at an injection timing and duration under control of the ECU. The ECU can control the injection timing and duration according to any known control strategy which preferably refers to a signal from at least one engine sensor, such as, for example, but without limitation, a throttle valve position sensor 171 (see FIG. 5).

With reference now to FIGS. 6 and 7, a preferred arrangement of the throttle bodies 152A–C will be now described. Each throttle body 152A–C is separately formed and coupled together by a lower linkage rail 180 and an upper linkage rail 182. More specifically, each throttle body 152A–C has a lower flange 184 extending downward from the bottom thereof and defining a vertical face and an upper flange 186 extending upward and defining a horizontal face. The respective lower flanges 184 are affixed to the vertical faces of the lower linkage rail 180 by lower screws 188, while the respective upper flanges 186 are affixed to the respective horizontal faces of the upper linkage rail 182 by upper screws 190.

In the illustrated arrangement, the linked throttle bodies 152A–C are positioned on the starboard side of the crankcase member 100. As mentioned above, the linked throttle bodies 152A–C communicate with the crankcase member 100 through the intake manifold 118. As such, in the illustrated arrangement, each throttle body 152A–C includes an outlet nipple 192, which is surrounded by a sleeve portion 194 of the intake manifold 118. Bands 196 are preferably provided around the periphery of the sleeve portions 194 so as to secure the sleeve portions 194 to the outlet nipples 192 of the throttle bodies 152A–C.

Figure 8:
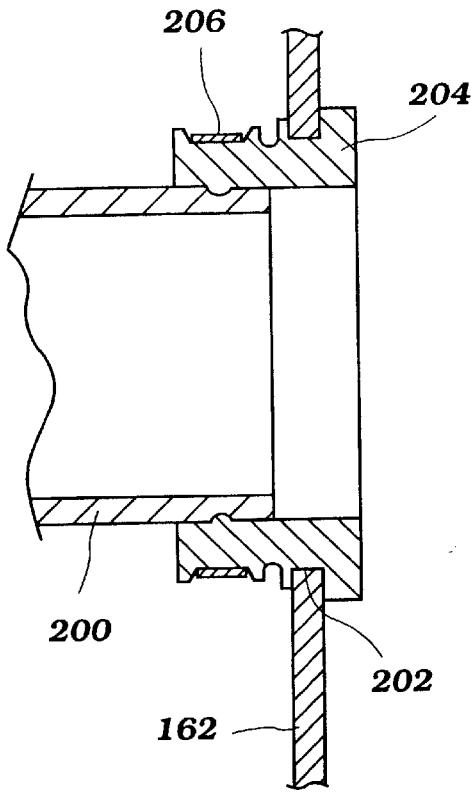
FIG. 8 illustrates the connection between a first intake box and an intake pipe of the engine of FIG. 1.

In a similar manner, the linked throttle bodies 152A–C also communicate with the first intake box 162. As best seen in FIGS. 6 and 8, each throttle body 152A–C includes an inlet nipple 200. Each inlet nipple 200 is aligned with an outlet 202 formed in the first intake box 162. In the illustrated arrangement, rubber sleeves 204 are fitted within each outlet 202. The rubber sleeves 204 surround the inlet nipples 200 of the throttle bodies 152A–C and are preferably secured to the inlet nipples 200 by bands 206. In this manner, the throttle bodies 152A–C and intake manifold 154 define an intake passage 208 that extends between the first intake box 162 and the crankcase member 100.

Figure 5:
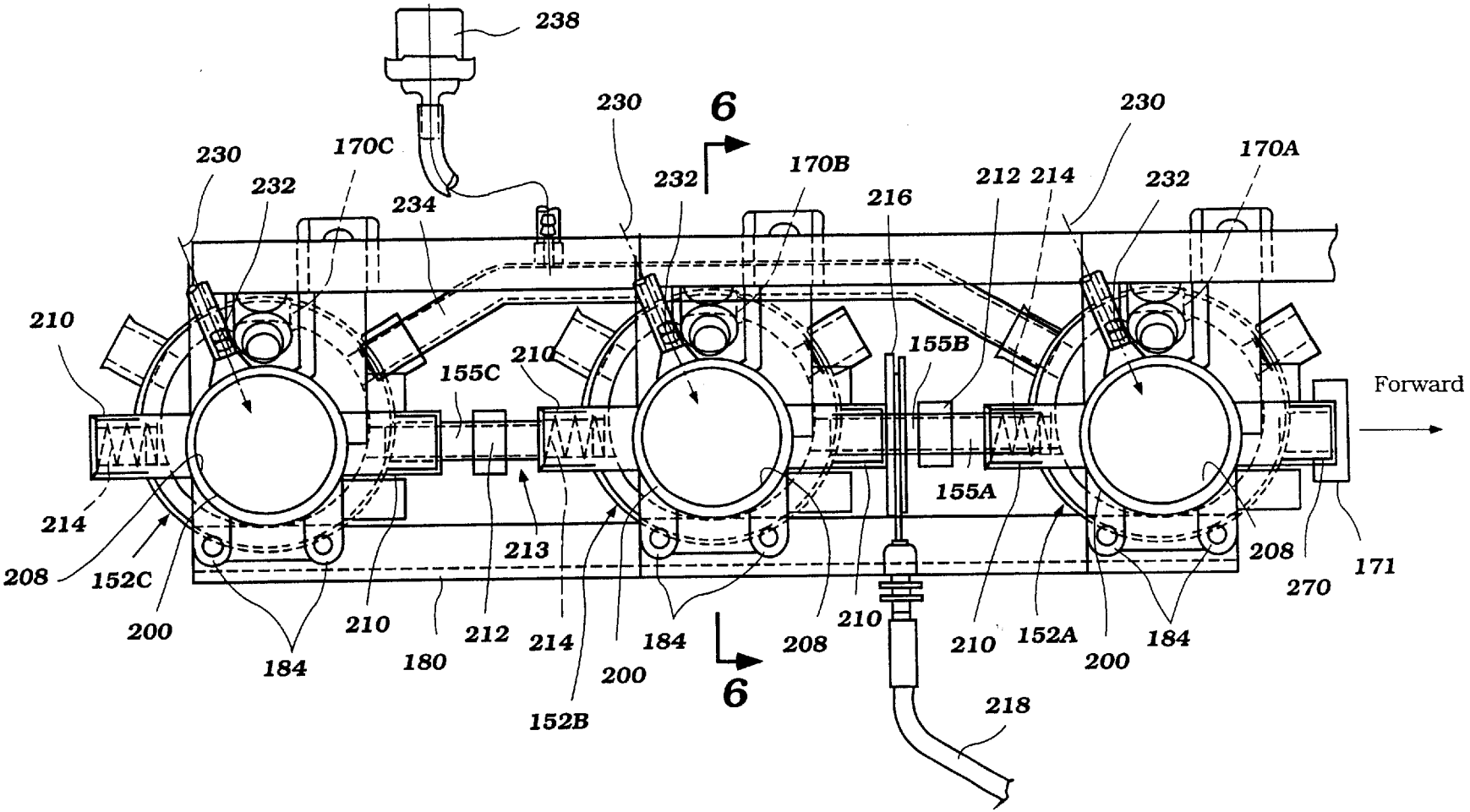
FIG. 5 is a side view of a throttle valve control mechanism of the engine in accordance with a preferred embodiment of the present invention.

With reference to FIGS. 5 and 6, the throttle valve shafts 155A–C are journaled by bearing portions 210 within the throttle bodies 152A–C for pivotal movement. Coupling members 212 couple the throttle valve shafts 155A–C to one another to form a valve shaft combination 213. As such, the valve shafts 155A–C pivot together. One or more return springs 214 are provided, for example, around the respective throttle valve shafts 155A–C in the bearing portions 210 so as to bias the shafts 155A–C toward a position in which the throttle valves 153A–C are closed (i.e., the position shown in FIG. 6). In other words, the throttle valves 153A–C are urged toward the closed position unless an actuation force is applied to the valve shafts 155A–C. In the illustrated arrangement, the throttle valve position sensor 171 is positioned at the forward end of the valve shaft combination 213; however, other locations of the sensor 171 are possible (e.g., between the throttle bodies 152A–C or at the rear end of the valve shaft combination 213)

In a preferred arrangement, a pulley 216 is positioned between two adjacent throttle bodies 152A–C and is attached to one of the throttle valve shafts 155A–C. For example, in the illustrated arrangement, the pulley 216 is attached to the middle throttle shaft 155B. A throttle wire 218 is coiled around the pulley 216. The throttle wire 218, in turn, is connected to the throttle lever 58, in the illustrated embodiment, so that the rider can manually operate the valve shafts 155A–C through the throttle wire 218. The throttle wire 218 also can connect to another type of actuating mechanism.

This arrangement of the pulley 216 and the throttle wire 218 is preferred for several reasons. For example, in the prior art, the pulley is typically positioned at one end of the valve shaft combination 213 and is not located between adjacent throttle bodies. This arrangement makes it difficult to synchronize the opening and closing of the throttle valve closest to the pulley with the throttle valve that is farthest from the pulley. This difficulty is caused, in part, by the twisting of the throttle valve combination due to the torque exerted at one end of the combination. By positioning the pulley 216 on the combination 213 between throttle bodies 152A–C, the torque exerted on the combination 213 over its entire length is reduced and the twisting along the throttle valve combination 213 is mitigated. As such, the synchronizing of the throttle valves 153A–C is improved and the position of the throttle valves 153A–C as indicated by the throttle valve position sensor 171 is more accurately determined for all of the throttle valves 153A–C.

With continued reference to FIGS. 5 and 6, the fuel injectors 170A–C are positioned within holes 220 that are preferably formed in an upper side of the throttle bodies 152A–C. Preferably, the fuel injectors 170A–C are also positioned so that each nozzle portion 222 of the injector 170A–C is directed towards the intake passage 208 downstream of the throttle valves shafts 155A–C. An inlet end 224 of the fuel injectors 170A–C is connected to the fuel rail 172 that, as mentioned above, supplies fuel to the fuel injectors 170A–C.

As best seen in FIG. 7, in a preferred arrangement, the fuel injectors 170A–C and the fuel rail 172 are generally disposed within a space, which is defined by the throttle bodies 152AC, the first intake box 162, and portions of the exhaust system 120, specifically, the expansion chamber 128, the catalyst assembly 134 and the exhaust pipe 134. More preferably, as best seen in FIG. 6, the inlet end 224 of the fuel injectors 170A–C and the fuel rail are arranged such that these components lie between a first plane P1 that passes through an axis of the throttle valve shafts 155A–C and a second plane P2, which lies generally along the centerline of the intake passage 208 and also extends through the axis of the throttle valve shafts 155A–C. This arrangement protects the fuel injectors 170A–C and the fuel rail 172 from water that can accumulate in the bottom of the internal cavity 40 and splash upward during use of the personal watercraft 30. Specifically, when the personal watercraft 30 turns quickly, this water can splash onto and damage the fuel injectors 170A–C and the fuel rail 172. In particular, sea water is particularly corrosive to metals, rubber and gasket materials, which are provided between the fuel injectors 170A–C, the throttle bodies 152A–C and the intake manifold 154. However, in the arrangement describe above, the surrounding components generally protect the fuel injectors 170A–C and the fuel delivery conduit 172 (e.g., the fuel rail in the illustrated embodiment) from such water.

With continued reference to FIG. 6, the throttle bodies 152A–C preferably are arranged such that lubricant 230 can be injected toward the journaled portions of the valve shafts 155A–C in the intake passages 208. The throttle bodies preferably are also arranged such that lubricant 230 can be injected into the fuel injection holes 220 through lubrication nozzles 232 (see FIG. 5) such that lubricant can be introduced into the engine 32 with the fuel and air charge.

A balancing passage 234 (FIGS. 5 and 6) is preferably provided with an inlet 236 to the intake passage 208 formed in the intake manifold 154. The balancing passage 234 is in communication with an intake air pressure sensor 238, which can be used by the ECU to control the amount of fuel injected by the fuel injectors 170A–C.

Figure 9:
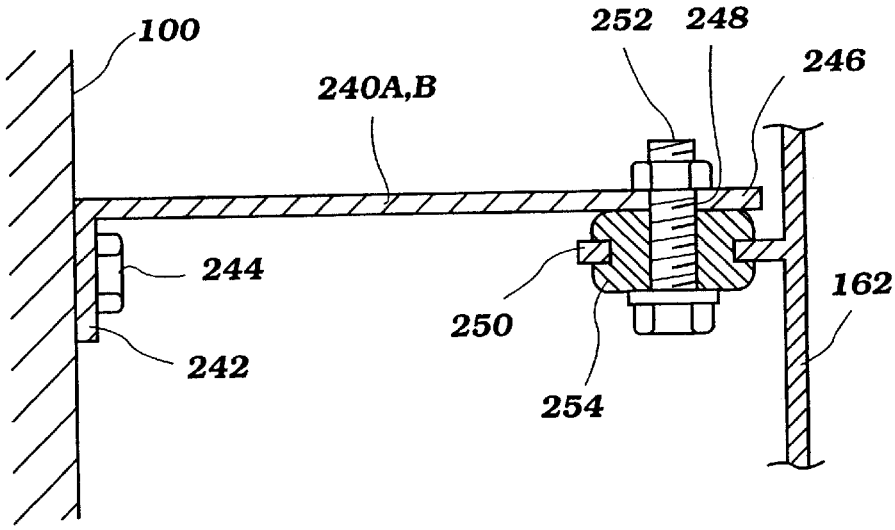
FIG. 9 illustrates the connection between the first intake box and the engine of FIG. 1.

With reference now to FIGS. 3, 7 and 9, the first intake box 162, in the illustrated embodiment, has a generally rectangular shape and extends along the starboard side of the engine 32. As mentioned above, the illustrated first intake box has three outlets 202, which are connected to the inlet nipples 200 of the throttle bottles by rubber sleeves 204. As such, in the illustrated arrangement, the throttle bodies 152A–C are positioned between the first intake box 162 and the intake manifold 154 on the starboard side of the engine body 108.

In a preferred arrangement, the first intake box 162 is supported on the starboard side of the engine 32 by a plurality stays 240A, B. As best seen in FIGS. 7 and 9, the stays 240A, 240B include a flange 242, which is secured to the crankcase member 100 by a bolt 244. Opposing the flange 242, the stays 240A, 240B include an end portion 246 that defines a bolt hole 248. The intake box 162, in turn, includes a bracket member 250. A bolt 250 preferably extends through the bracket member 250 and end portion 246 so as to secure the intake box to the stay 240A, 240B. A rubber bushing 252 preferably is provided between the bracket member 250 and the end portion 246 so as to reduce vibrations that may be transmitted from the crankcase member 100 to the first intake box 162 and to provide heat insulation between these two components.

With particular reference to FIG. 7, the first intake box 162 preferably is formed by a combination of a first member 256 and a second member 258. Each member 256, 258 preferably includes interlocking flanges 260, which are secured to each other by a locking mechanism 262. The first and second members 256, 258 define a main body 257, which defines an internal cavity 259.

As mentioned above, the first intake box 162, the throttle bodies 152A–C and portions of the exhaust system 120 define a space S in which the fuel injectors 170A–C and the fuel rail 172 are positioned. Within this space, the fuel injectors 170A–C and the fuel rail 172 are generally protected from water in the cavity 40 that may splash on these components during operation of the watercraft 30. However, when the engine 32 of the watercraft 40 is stopped, cooling water typically is no longer supplied to the cooling passages 143 that surround the outlet of the C-shaped downstream section 132, the catalyst assembly 134 and the exhaust pipe 134 (i.e., the portions of the exhaust system 120 that lie above the fuel injectors 170A–C and the fuel rail 172). In such a situation, the catalyst 140 continues to radiate heat. This heat may damage the fuel injectors 170A–C and the fuel rail 172, which are located generally below the catalyst assembly 134.

The first intake box 162 is configured to shield the fuel injectors 170A–C and the fuel frail 172 from the heat generated by the catalyst 140. For example, the intake box 162 preferably includes a recess 266. The recess 266 is positioned on the side of the first intake box 162 that faces the fuel injectors 170A–C. As best seen in FIG. 7, the recess 266 is configured such that the starboard side of the fuel rail 172 is located at least partially within the recess 266. That is, the recess 266 includes an upper portion 268 and a lower portion 270 that lie, at least partially, above and below the fuel rail 172. The first intake box 162 preferably also includes an upper shield or visor 272, which extends from the main body 257 of the first intake box 162, above the fuel rail 172 between the expansion chamber 128 and the fuel injectors 170A–C. A lower shield or visor 274 preferably is also provided below the intake bodies 152A–C. The lower shield 274 extends from the main body 257 of the first intake box 162 towards the crankcase member and provides additional protection for the fuel injectors 170A–C and the fuel delivery conduit 172 (e.g., the fuel rail in the illustrated embodiment) from water in the cavity that may splash up and cause damage.

The remaining portions of the induction system 150 will now be described. As mentioned above, the induction system 150 preferably includes a second intake box 164, which is best seen in FIG. 3. In the illustrated arrangement, the second intake box 164 is located forward of the engine 32 between the fuel tank 66 and the engine 32. The second intake box 164 includes at least one intake opening 279 through which air in the cavity 40 can flow into the second intake box 164. The second intake box 164 communicates with the first intake box 162 via a conduit 280. The conduit 280 preferably is constructed of a flexible material, such as rubber. The conduit 280 connects inlet and outlet portions 282, 284 of the first and second intake boxes 162, 164 and preferably is connected to these inlet and outlet portions 282, 284 by band clamps 286.

With continued reference to FIG. 3, the induction system 150 preferably also includes a branched intake air chamber 290, which communicates with the conduit 280 through a branch conduit 292. Preferably, the chamber 290 and the conduit 292 form a Helmholtz resonator wherein the chamber 290 forms a resonator chamber and the conduit 292 forms a throat. As is known in the art, a Helmholtz resonator can be turned so as to provide sound attenuation over a desired sound range. Preferably, the chamber 290 and conduit 292 are tuned to attenuate sound at about 360 Hz. The chamber 290 and the conduit 292 may have the same cross-sectional area.

Figure 10:
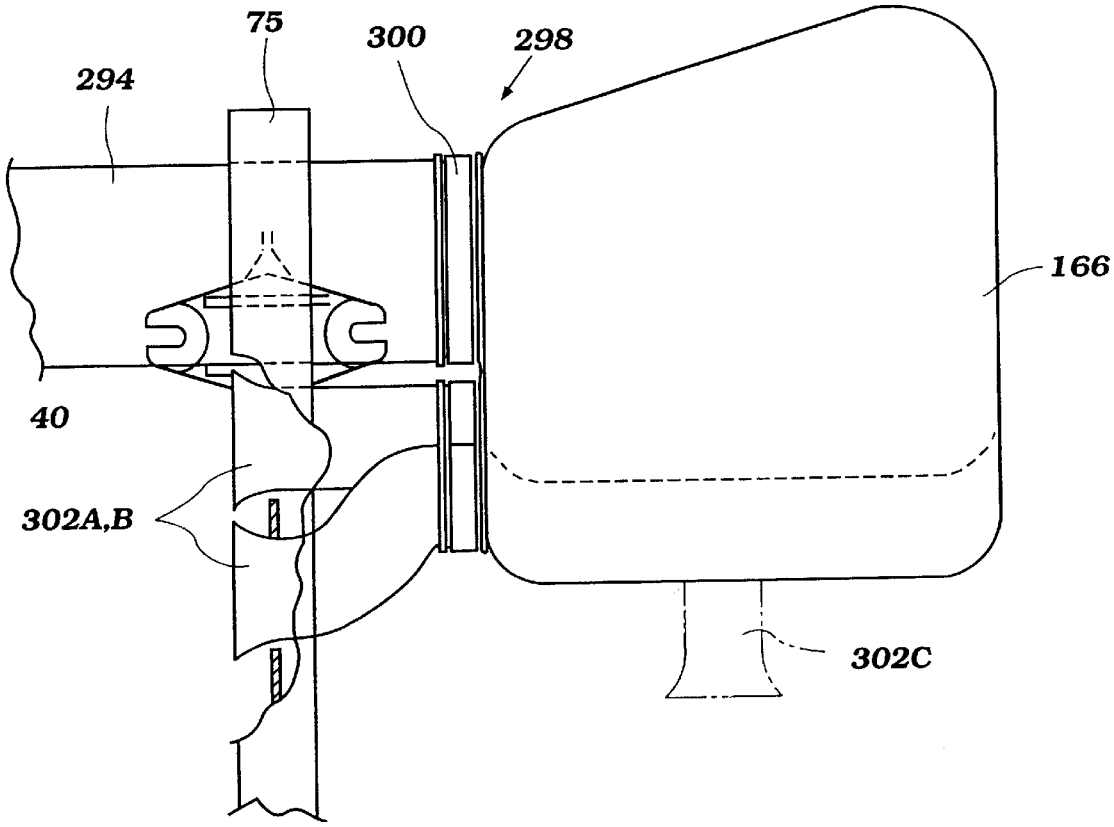
FIG. 10 illustrates another intake box and a portion of a bulkhead of the watercraft of FIG. 1.

With reference now to FIG. 10, the third intake box 166 preferably is positioned behind the engine body 108. In the illustrated embodiment, the third intake box 166 is positioned behind the bulkhead 75. As with the second intake box 164, the third intake box 164 communicates with the first intake box 162 via a conduit 294, which preferably is constructed of a flexible material, such as rubber. The conduit 264 connects inlet and outlet portions 296, 298 of the first and third intake boxes 162, 166 and preferably is connected to these inlet and outlet portions 296, 298 by band clamps 300.

The third intake box 166 includes one or more intake ducts 302A–C through which air can enter the third intake box 166. In the illustrated arrangement, the third intake box 166 includes three intake ducts 302A–C. Two of the intake ducts 302A, 302B preferably are supported by the bulkhead 75 and have their inlets exposed to the internal cavity 40. The third intake duct 302C preferably is disposed in an internal cavity defined behind the bulkhead 75 within the hull 34 of the watercraft. As shown in FIG. 10, the inlet to the third intake duct 302C preferably is disposed in a downwardly direction so as to prevent water from entering the induction system 120.

Of course, the foregoing description is that of preferred embodiments of the invention and various changes, modifications and combinations may be made without departing from the spirit and scope of the invention, as defined by the appended claims.

What is claimed is:

1. A small watercraft comprising a hull defining an engine compartment, an internal combustion engine disposed within the engine compartment and having an engine body containing at least one combustion chamber, the engine including an output shaft that drives a propulsion device of the watercraft, an induction system arranged within the hull to supply air to the combustion chamber, the induction system including at least one intake conduit, at least one throttle body communicating with the intake conduit, and at least one intake box, the intake conduit having an outlet end connected to the engine body and extending generally away from the engine body, the throttle body being connected to an inlet of the intake conduit and also generally extending away from the engine body, the intake conduit and the throttle body defining an intake passage, the intake box being connected to an inlet end of the throttle body, at least one fuel injector connected to a fuel delivery conduit and arranged to inject fuel into the intake passage, the at least one fuel injector and the fuel delivery conduit being generally disposed on an upper side of the throttle body between the intake box and the engine body, the intake box defining a recess in which at least a portion of the fuel delivery conduit or the fuel injector is at least partially disposed.

2. The watercraft of claim 1, wherein the intake box further includes a shield positioned generally above at least a portion of the fuel delivery conduit and the fuel injector.

3. The watercraft of claim 1, wherein the intake box further includes a shield positioned generally below at least a portion of the throttle body.

4. The watercraft of claim 1, further including an exhaust system arranged within the hull to guide exhaust gases from the engine body, a portion of the exhaust system being disposed generally above the fuel injector and the fuel delivery conduit such that the fuel injector and the fuel delivery conduit are disposed within a space lying between the portion of the exhaust system, the throttle body and the intake box.

5. The watercraft of claim 4, wherein said intake box further includes a shield that is positioned generally above the fuel delivery conduit and the fuel injector and is disposed at least partially between the portion of the exhaust system and the fuel delivery conduit.

6. The watercraft of claim 5, wherein the portion of the exhaust system includes a catalyst.

7. The watercraft of claim 1, further including an exhaust system arranged within the hull to guide exhaust gases from the engine body, the exhaust system including an exhaust manifold generally positioned on a side of the engine opposite the intake manifold, the exhaust manifold extending in a generally upward direction, the exhaust manifold being connected to an exhaust that wraps around a front side of the engine and has an outlet that lies on a side of the engine opposite the exhaust manifold, the outlet of the exhaust being connected to a catalyst assembly that includes a catalyst, the catalyst assembly being connected to an exhaust pipe, the outlet of the exhaust conduit, the catalyst assembly and the exhaust pipe being at least partially disposed higher than the fuel injector and the fuel delivery conduit.

8. The watercraft of claim 1, wherein said intake box further includes a shield that is positioned generally above at least a portion of the fuel delivery conduit and the fuel injector and is disposed at least partially in a space between the fuel delivery conduit and a portion of the exhaust system.

9. The watercraft of claim 1, wherein the throttle body includes a throttle valve, and the fuel injector is arranged to inject fuel into the intake passage downstream of the throttle valve.

10. The watercraft of claim 1, wherein the induction system includes at least a first throttle body and a second throttle body, the first throttle body including a first throttle valve positioned on a first throttle shaft, the second throttle body including a second throttle valve positioned on a second throttle shaft, a pulley mounted on either the first or second throttle shaft and disposed between the first and second throttle bodies, the pulley being coupled to a throttle operator.

11. The watercraft of claim 10, wherein the first and second throttle shafts are coupled together by a coupling.

12. The watercraft of claim 1, wherein intake conduit communicates with a crankcase of the engine.

13. A small watercraft comprising a hull defining an engine compartment, an internal combustion engine disposed within the engine compartment and having an engine body containing at least one combustion chamber, the engine including an output shaft that drives a propulsion device of the watercraft, an induction system arranged within the hull to supply air to the combustion chamber, the induction system including at least one intake conduit, at least one throttle body communicating with the intake conduit, and at least one intake box, the intake conduit having an outlet end connected to the engine body and extending generally away from the engine body, the throttle body being connected to an inlet of the intake conduit and also generally extending away from the engine body, the intake conduit and the throttle body defining an intake passage, the intake box being connected to an inlet end of the throttle body, at least one fuel injector connected to a fuel delivery conduit and arranged to inject fuel into the intake passage, the at least one fuel injector and the fuel delivery conduit being generally disposed on an upper side of the throttle body between the intake box and the engine body, the intake box defining a shield positioned generally above or generally below at least a portion of the fuel delivery conduit or the fuel injector.

14. The small watercraft of claim 13, wherein the intake box also defines a recess in which a portion of the fuel delivery conduit or the fuel injector is at least partially disposed.

15. The watercraft of claim 13, further including an exhaust system arranged within the hull to guide exhaust gases from the engine body, a portion of the exhaust system being disposed generally above the fuel injector and the fuel delivery conduit such that the fuel injector and the fuel delivery conduit are disposed within a space lying between the portion of the exhaust system, the throttle body and the intake box.

16. The watercraft of claim 15, wherein the shield is positioned generally above the fuel delivery conduit and the fuel injector and is disposed at least partially between the portion of the exhaust system and the fuel delivery conduit.

17. The watercraft of claim 16, wherein the portion of the exhaust system includes a catalyst.

18. The watercraft of claim 13, further including an exhaust system arranged within the hull to guide exhaust gases from the engine body, the exhaust system including an exhaust manifold generally positioned on a side of the engine opposite the intake manifold, the exhaust manifold extending in a generally upward direction, the exhaust manifold being connected to an exhaust that wraps around a front side of the engine and has an outlet that lies on a side of the engine opposite the exhaust manifold, the outlet of the exhaust being connected to a catalyst assembly that includes a catalyst, the catalyst assembly being connected to an exhaust pipe, the outlet of the exhaust conduit, the catalyst assembly and the exhaust pipe being at least partially disposed higher than the fuel injector and the fuel delivery conduit.

19. The watercraft of claim 13, wherein the shield is positioned generally above at least a portion of the fuel delivery conduit and the fuel injector and is disposed at least partially in a space between the fuel delivery conduit and a portion of the exhaust system.

20. The watercraft of claim 13, wherein the throttle body includes a throttle valve, and the fuel injector is arranged to inject fuel into the intake passage downstream of the throttle valve.

21. The watercraft of claim 13, wherein the induction system includes at least a first throttle body and a second throttle body, the first throttle body including a first throttle valve positioned on a first throttle shaft, the second throttle body including a second throttle valve positioned on a second throttle shaft, a pulley mounted on either the first or second throttle shaft and disposed between the first and second throttle bodies, the pulley being coupled to a throttle operator.

22. The watercraft of claim 21, wherein the first and second throttle shafts are coupled together by a coupling.

23. The watercraft of claim 13, wherein intake conduit communicates with a crankcase of the engine.

24. A small watercraft comprising a hull defining an engine compartment, an internal combustion engine disposed within the engine compartment and having an engine body containing at least one combustion chamber, the engine including an output shaft that drives a propulsion device of the watercraft, an induction system arranged within the hull to supply air to the combustion chamber, the induction system including at least one intake conduit, at least a first throttle body and a second throttle body communicating with the intake conduit, and at least one intake box, the intake conduit having an outlet end connected to the engine body and extending generally away from the engine body, the throttle body being connected to an inlet of the intake conduit and also generally extending away from the engine body, the intake conduit and the throttle body defining an intake passage, the intake box being connected to an inlet end of the throttle body, at least one fuel injector connected to a fuel delivery conduit and arranged to inject fuel into the intake passage, the first throttle body including a first throttle valve positioned on a first throttle shaft, the second throttle body including a second throttle valve positioned on a second throttle shaft, a pulley mounted on either the first or second throttle shaft and disposed between the first and second throttle bodies, the pulley being coupled to a throttle operator.

25. The watercraft of claim 24, wherein the first and second throttle shafts are coupled together by a coupling.

26. The watercraft of claim 24, wherein the intake conduit communicates with a crankcase of the engine.

27. A small watercraft comprising a hull defining an engine compartment, an internal combustion engine disposed within the engine compartment and having an engine body containing at least one combustion chamber, the engine including an output shaft that drives a propulsion device of the watercraft, an induction system arranged within the hull to supply air to the combustion chamber, the induction system including at least one intake conduit, at least one throttle body communicating with the intake conduit, and at least one intake box, the intake conduit having an outlet end connected to the engine body and extending generally away from the engine body, the throttle body being connected to an inlet of the intake conduit and also generally extending away from the engine body, the intake conduit and the throttle body defining an intake passage, the intake box being connected to an inlet end of the throttle body, at least one fuel injector connected to a fuel delivery conduit and arranged to inject fule into the intake passage, the at least one fuel injector and the fuel delivery conduit being generally disposed on a side of the throttle body between the intake box and the engine body, the intake box defining a recess in which at least a portion of the fuel delivery conduit or the fuel injector is at least partially disposed.

28. The watercraft of claim 27, wherein the intake box further includes a shield positioned generally above at least a portion of the fuel delivery conduit and the fuel injector.

29. The watercraft of claim 27, wherein the intake box further includes a shield positioned generally below at least a portion of the throttle body.

30. The watercraft of claim 27, further including an exhaust system arranged within the hull to guide exhaust gases from the engine body, a portion of the exhaust system being disposed generally above the fuel injector and the fuel delivery conduit such that the fuel injector and the fuel delivery conduit are disposed within a space lying between the portion of the exhaust system, the throttle body and the intake box.

31. The watercraft of claim 30, wherein said intake box further includes a shield that is positioned generally above the fuel delivery conduit and the fuel injector and is disposed at least partially between the portion of the exhaust system and the fuel delivery conduit.

32. The watercraft of claim 31, wherein the portion of the exhaust system includes a catalyst.

33. The watercraft of claim 27, further including an exhaust system arranged within the hull to guide exhaust gases from the engine body, the exhaust system including an exhaust manifold generally positioned on a side of the engine opposite the intake manifold, the exhaust manifold extending in a generally upward direction, the exhaust manifold being connected to an exhaust that wraps around a front side of the engine and has an outlet that lies on a side of the engine opposite the exhaust manifold, the outlet of the exhaust being connected to a catalyst assembly that includes a catalyst, the catalyst assembly being connected to an exhaust pipe, the outlet of the exhaust conduit, the catalyst assembly and the exhaust pipe being at least partially disposed higher than the fuel injector and the fuel delivery conduit.

34. The watercraft of claim 27, wherein said intake box further includes a sheild that is positioned generally above at least a portion of the fuel delivery conduit and the fuel injector and is disposed at least partially in a space between the fuel delivery conduit and a portion of the exhaust system.

35. The watercraft of claim 27, wherein the throttle body includes a throttle valve, and the fuel injector is arranged to inject fuel into the intake passage downstream of the throttle valve.

36. The watercraft of claim 27, wherein the induction system includes at least a first throttle body and a second throttle body, the first throttle body including a first throttle valve positioned on a first throttle shaft, the second throttle body including a second throttle valve positioned on a second throttle shaft, a pully mounted on either the first or second throttle shaft and disposed between the first and second throttle bodies, the pully being coupled to a throttle operator.

37. The watercraft of claim 36, wherein the first and second throttle shafts are coupled together by a coupling.

38. The watercraft of claim 27, wherein intake conduit communicates with a crankcase of the engine.

39. A small watercraft comprising a hull defining an engine compartment, an internal combustion engine disposed within the engine compartment and having an engine body containing at least one combustion chamber, the engine including an output shaft that drives a propulsion device of the watercraft, an induction system arranged within the hull to supply air to the combustion chamber, the induction system including at least one intake conduit, at least one throttle body communicating with the intake conduit, and at least one intake box, the intake conduit having an outlet end connected to the engine body and extending generally away from the engine body, the throttle body being connected to an inlet of the intake conduit and also generally extending away from the engine body, the intake conduit and the throttle body defining an intake passage, the intake box being connected to an inlet end of the throttle body, at least one fuel injector connected to a fuel delivery conduit and arranged to inject fuel into the intake passage, the at least one fuel injector and the fuel delivery conduit being generally disposed on a side of the throttle body between the intake box and the engine body, the intake box defining a shield positioned generally above or generally below at least a portion of the fuel delivery conduit or the fuel injector.

40. The small watercraft of claim 39, wherein the intake box also defines a recess in which a portion of the fuel delivery conduit or the fuel injector is at least partially disposed.

41. The watercraft of claim 39, further including an exhaust system arranged within the hull to guide exhaust gases from the engine body, a portion of the exhaust system being disposed generally above the fuel injector and the fuel delivery conduit such that the fuel injector and the fuel delivery conduit are disposed within a space lying between the portion of the exhaust system, the throttle body and the intake box.

42. The watercraft of claim 41, wherein the shield is positioned generally above the fuel delivery conduit and the fuel injector and is disposed at least partially between the portion of the exhaust system and the fuel delivery conduit.

43. The watercraft of claim 42, wherein the portion of the exhaust system includes a catalyst.

44. The watercraft of claim 39, further including an exhaust system arranged within the hull to guide exhaust gases from the engine body, the exhaust system including an exhaust manifold generally positioned on a side of the engine opposite the intake manifold, the exhaust manifold extending in a generally upward direction, the exhaust manifold being connected to an exhaust that wraps around a front side of the engine and has an outlet that lies on a side of the engine opposite the exhaust manifold, the outlet of the exhaust being connected to a catalyst assembly that includes a catalyst , the catalyst assembly being connected to an exhaust pipe, the outlet of the exhaust conduit, the catalyst assembly and the exhaust pipe being at least partially disposed higher than the fuel injector and the fuel delivery conduit.

45. The watercraft of claim 39, wherein the shield is positioned generally above at least a portion of the fuel delivery conduit and the fuel injector and is disposed at least partially in a space between the fuel delivery conduit and a portion of the exhaust system.

46. The watercraft of claim 39, wherein the throttle body includes a throttle valve, and the fuel injector is arranged to inject fuel into the intake passage downstream of the throttle valve.

47. The watercraft of claim 39, wherein the induction system includes at least a first throttle body and a second throttle body, the first throttle body including a first throttle valve positioned on a first throttle shaft, the second throttle body including a second throttle valve positioned on a second throttle shaft, a pulley mounted on either the first or second throttle shaft and disposed between the first and second throttle bodies, the pully being coupled to a throttle operator.

48. The watercraft of claim 47, wherein the first and second throttle shafts are coupled together by coupling.

49. The watercraft of claim 39, wherein intake conduit communicates with a crankcase of the engine.

* * * * *

UNITED STATES PATENT AND TRADEMARK OFFICE

CERTIFICATE OF CORRECTION

PATENT NO. : 6,551,156 B2
DATED : April 22, 2003
INVENTOR(S) : Mitsuyoshi Nakamura et al.

It is certified that error appears in the above-identified patent and that said Letters Patent is hereby corrected as shown below:

Column 13,
Line 61, please delete “upward” and insert -- upwardly --.

Column 15,
Line 5, please delete “fule” and insert -- fuel --.
Line 49, please delete “sheild” and insert -- shield --.
Lines 62 and 64, please delete “pully” and insert -- pulley --.

Signed and Sealed this

Thirteenth Day of July, 2004

JON W. DUDAS
*Acting Director of the United States Patent and Trademark Office*